US006109396A

United States Patent [19]

Sirag et al.

[11] Patent Number: 6,109,396

[45] Date of Patent: Aug. 29, 2000

[54] REMOTE ELEVATOR CALL PLACEMENT WITH PROVISIONAL CALL VERIFICATION

[75] Inventors: David Sirag, Ellington; Robert G. Morgan, Bolton; Charles R. Winston, Glastonbury, all of Conn.

[73] Assignee: Otis Elevator Company, Farmington, Conn.

[21] Appl. No.: 09/189,161

[22] Filed: Nov. 9, 1998

[51] Int. Cl.[7] ..... B66B 1/16

[52] U.S. Cl. ..... 187/381; 187/392

[58] Field of Search ..... 187/384, 389, 187/391, 392, 385, 387, 398, 381

[56] References Cited

U.S. PATENT DOCUMENTS

| | | | |
|---|---|---|---|
| 4,662,479 | 5/1987 | Kamaike | 187/121 |
| 4,673,911 | 6/1987 | Yoshida | 187/100 |
| 4,685,538 | 8/1987 | Tsuji et al. | 187/131 |
| 4,979,594 | 12/1990 | Begle et al. | 187/121 |
| 5,689,094 | 11/1997 | Friedli | 187/384 |
| 5,932,853 | 8/1999 | Friedli et al. | 187/392 |
| 5,949,037 | 9/1999 | Oya | 187/392 |
| 5,952,626 | 9/1999 | Zaharia | 187/381 |
| 5,984,051 | 11/1999 | Morgan et al. | 187/392 |

*Primary Examiner*—Jonathan Salata

[57] ABSTRACT

A remote control device transmits a request for elevator service while a passenger is some distance from the elevator; the call may be assigned to an elevator car, but the car stops for that particular passenger only if the call is verified by the passenger approaching the immediate vicinity of the elevator. In one embodiment, tags identifying beacons that cause requests to be made remotely of, in proximity with, and within the elevator identify the location from where each request is made. In other embodiments, which may use key operated devices, limited-sensitivity receivers, or receivers with directional reception patterns, including overlapping patterns, may be utilized to distinguish between elevator call requests made remotely and made in the vicinity of the elevator. Other methods of verifying presence of the calling device at the elevator may be used.

6 Claims, 6 Drawing Sheets

REMOTE ELEVATOR CALL PLACEMENT WITH PROVISIONAL CALL VERIFICATION

RELATED APPLICATIONS

Some of the matter disclosed herein is disclosed and claimed in commonly owned U.S. patent application Ser. No. 09/111,355 and U.S. Pat. Nos. 5,952,626 and 5,984,051.

TECHNICAL FIELD

This invention relates to entering elevator calls transmitted by electromagnetic radiation between the elevators and a portable device borne by a user, while the user is some distance from the elevator, completing the stop for the call only if the call is verified by the user being in the immediate proximity of the elevator, and entering a car call only if the user enters the cab.

BACKGROUND ART

Elevator systems have recently been provided with two features which are thought to save considerable passenger time and increase the carrying capacity of a given elevator installation. The first of these is utilizing destination calls, by which the passenger does not simply call an elevator to his floor, but at the same time informs the elevator of the intended destination floor. This allows the dispatcher (typically a suitably programmed computer) to allocate the call to the most appropriate car, taking into account not only the origin, but also the destination of the passenger.

A second feature automatically enters elevator calls while the passengers are still at some distance (equivalent to about ten seconds, in one case) from the elevator, whereby the dispatcher can attempt to cause the elevator to arrive at nearly the same time that the passenger reaches the elevator.

Typical problems with these systems include numerous false calls. Some of the false calls are caused by the person deciding not to enter the elevator, and going elsewhere, such as to purchase a newspaper.

DISCLOSURE OF INVENTION

Objects of the invention include improvements in remotely-entered elevator calls; improved remote entry of elevator calls; improved automatic entry of elevator calls; reducing false calls in an elevator system responding to remotely-entered calls; reducing false calls in an elevator system employing automatic destination calls; providing improvements in elevator system operation; and reduced elevator service time.

According to the present invention, a personal remote control device uses appropriate electromagnetic transmissions to enter an elevator call while the user is some distance from the elevator, and the call is verified when the user is in the immediate vicinity of the elevator, and when the user is in the elevator cab. According to the invention, distinction between elevator call request transmissions which are made remotely of the elevator, and those which are made in the immediate vicinity of or on the elevator may be distinguished in several ways. For instance, if receivers having a limited sensitivity are disposed remotely of the elevator and in the vicinity of or on the elevator, such receivers will respond only to call requests made when close to them, and the identity of the receiver determines whether the call request is transmitted remotely of in proximity with, or on the elevator. Or, requests received at two receivers may be compared, the one receiving the strongest signal being indicative of the location where the call was made. Directional receivers may be used in a variety of ways to distinguish between remote and local call requests, such as having overlapping reception fields of two directional antennas to identify locally made call requests. The invention may be practiced utilizing a remotely transmitted elevator call request, with a different manner of sensing when the device is in proximity of the elevator, such as conventional passive RFID. However, the best mode for practicing the invention is believed to be utilizing limited power beacons which transmit their own identity in their prompt messages, as in the aforementioned U.S. Pat. No. 5,984,051, the elevator call request message transmitted by the personal device including in its call message the identification of the beacon that alerted it; that way the identification of a particular beacon will distinguish between call requests from various different locations.

Other objects, features and advantages of the present invention will become more apparent in the light of the following detailed description of exemplary embodiments thereof, as illustrated in the accompanying drawing.

BEST MODE FOR CARRYING OUT THE INVENTION

Figure 1:
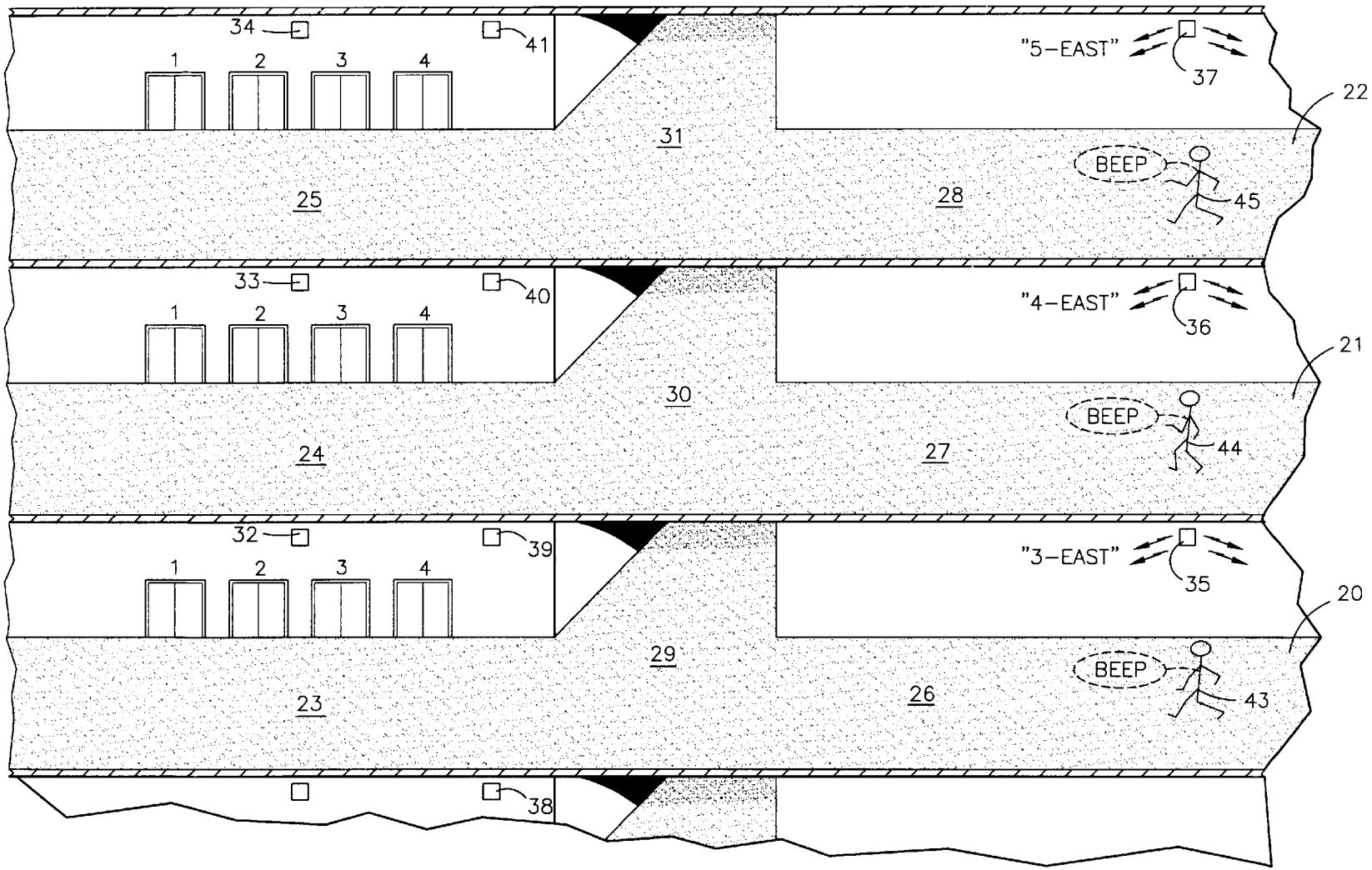
FIGS. 1–4 are partial, partially sectioned, perspective views of three floors of a building, illustrating a sequence of operation of the present invention as various persons approach elevator lobbies.
Figure 2:
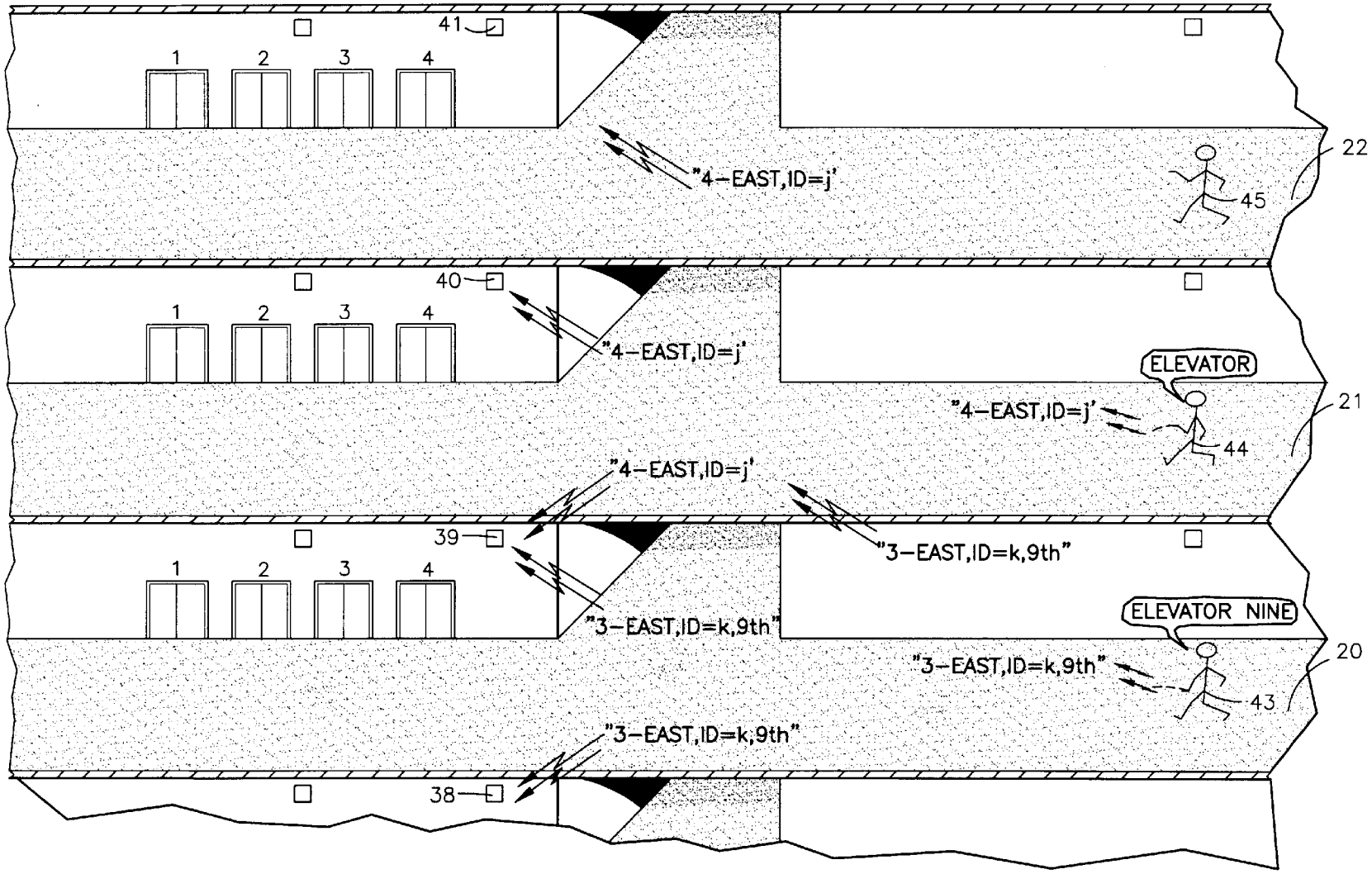

Referring now to FIG. 1, three floors of a building 20–22, each include an elevator landing 23–25, corresponding entrance corridors 26–28, and other corridors 29–31. Each of the corridors 26–28 has corresponding prompt beacons 32–37 that periodically (several times per second) transmit a prompt to alert personal devices carried by passengers (not shown in FIG. 1) that the general proximity of the elevators has been reached. The prompt is electromagnetic radiation, which may be selected from various available bands, such as 125 KHz or 315 MHz. Each of the elevator landings 23–25 has an electromagnetic transceiver 39–41 which can both transmit and receive messages by means of electromagnetic radiation. In FIG. 1, three persons 43–45 are shown entering corresponding corridors 26–28 at a time when each prompt transmitter 35–37 is transmitting an electromagnetic signal which comprises a beacon type prompt. Each person 43–45 is bearing a remote control device not shown in FIGS. 1–6 for clarity. The remote control devices may take the form of a verbal device described with respect to FIG. 9 of aforementioned U.S. Pat. No. 5,952,626, or a keyed device described with respect to FIG. 10 of said application. In response to the beacon prompt, each verbal remote control device (in the example of FIG. 1) will issue an audible prompt, such as a beep (FIG. 1), for the person bearing the device to hear. In response to the audible prompt, as is shown in FIG. 2, the persons 43 and 44 desirous of entering an elevator will respond verbally. On the fourth floor, the person 44 simply says "elevator", which causes the verbal remote control device borne by him to transmit, electromagnetically, a message which includes information such as "elevator requested", the name of the beacon to which the device is responding (either 3-EAST or 4-EAST in the example) the identification number of the device (either k or j in the example of FIG. 2), and whether or not the bearer has indicated a desire to go to a floor other than the floor that the bearer normally goes to, referred to as the default floor herein. As seen in FIG. 2, it is assumed that the person 43 has requested the elevator to take him to the ninth floor, whereas the person 44 has requested the elevator, and decides to go to his default floor. In FIG. 2, the person 45 has said nothing, thereby indicating that he is not heading for the elevator. Alternatively, when prompted by the transceivers 35–37, the verbal remote control devices borne by the persons 43–45 might have synthesized the question "Elevator?", instead of using "beep" as a prompt. In reply to the request, the person 43 could have replied "yes . . . 9" or simply "9", and the person 44 could have simply replied "yes". In a system so devised, the person 45 might either remain silent or answer with the word "no". Optionally, the persons might use functional words to enter a specific call, such as "gym", "office" or "cafeteria". If desired, any human-discernable prompt, such as vibration (as in conventional paging units) may be used instead of audible prompts.

The messages are indicated in FIG. 2 as being transmitted to floors adjacent to the floor of the device; the floortags, "3", "4", cause each message to be recognized only on the intended floor as set forth in the aforementioned U.S. Pat. No. 5,984,051.

When each verbal remote control device has received a verbal reply from the person who is carrying it, it will transmit a corresponding message to a landing transceiver 39, 40, 41 (or a receiver positioned in any other suitable way), which includes the location of the beacon, the ID number of the device (person) and any request for a destination floor different from the default floor. In FIG. 2, the device borne by person 43 transmits a message identifying the person as that person on the east end of the third floor, having an assigned ID=k, and requesting service to the 9th floor; the device borne by person 44 transmits a message that simply identifies the bearer as being on the east end of the fourth floor, having an ID=j. The device on person 45 does not transmit any response, in this example.

Figure 3:
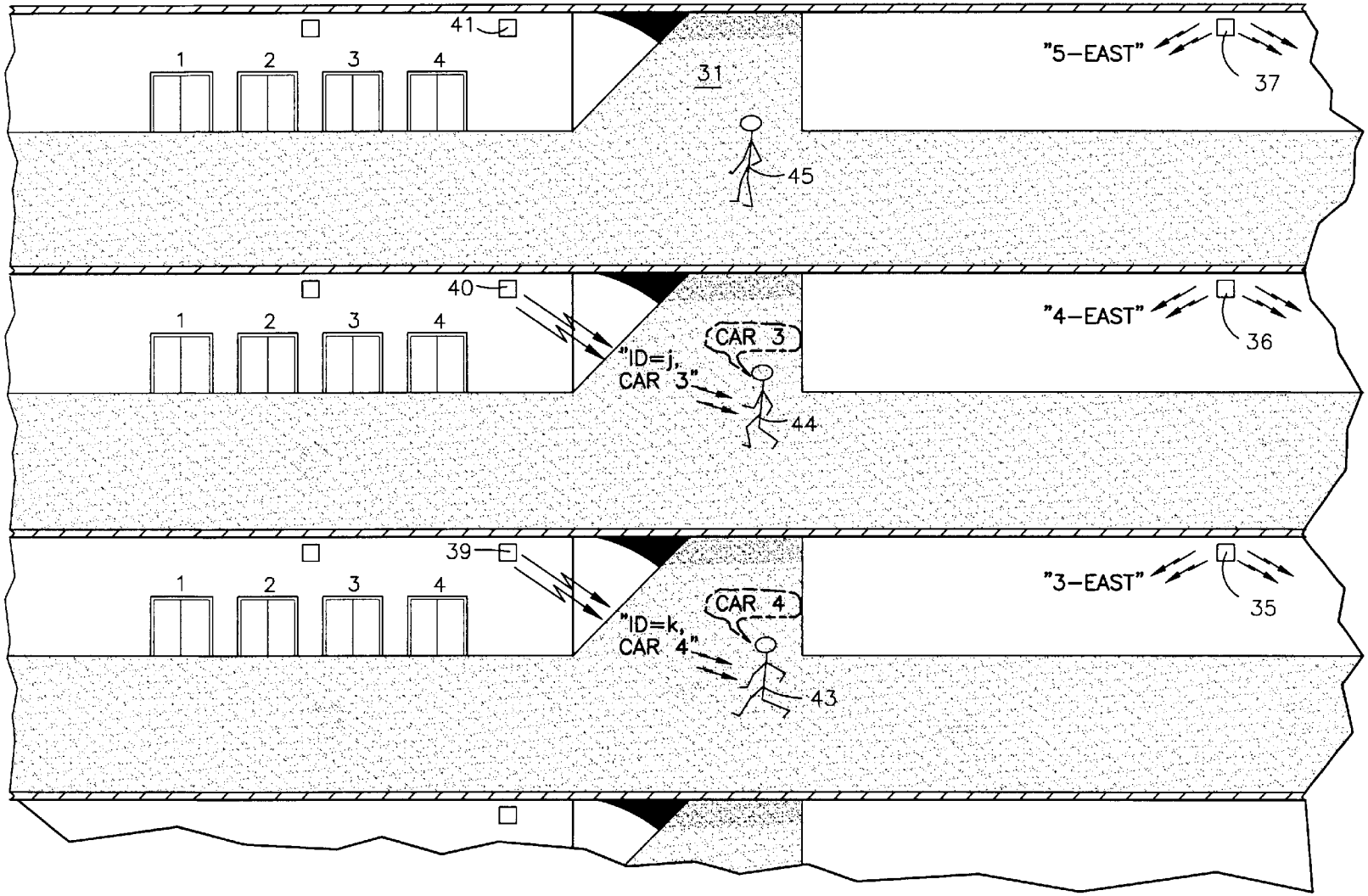

Once the transceivers 39, 40 have received messages indicative of the bearer's verbal response, the dispatcher of the elevator system, which may be any conventional dispatcher, enters a hall call for the corresponding floor (that is, floor 3 for person 43 and floor 4 for person 44), and also enters a destination request for the indicated floor (floor 9 for person 43) or the default floor if no request were made (for instance, floor 14 for person 44). The destination request is used in the dispatcher for making call allocations, but is not entered as a car call until the car stops at the origin floor, or preferably, until the related passenger enters the cab. The dispatcher selects which of the elevators (car 1-car 4) is the most appropriate to respond to the combined hall call/car call. Once the assignment is made, it is communicated to the transceiver 39, 40 of the floor corresponding to the hall call (floor 3 and floor 4, respectively). In turn, each transceiver 39, 40 electromagnetically transmits a corresponding message which identifies the ID of the device entering the call request. Thus, the transceiver 39 transmits a message including the information: the ID of the device requesting the call is k, and the call has been assigned to car four. Similarly, the transceiver 40 transmits a message including that the ID is j, and the call has been assigned to car 3. In response, the verbal remote control device utilizes voice synthesis to announce the car assignment for the call through a loudspeaker to the bearer thereof as shown in FIG. 3. Thus, the verbal remote control device borne by the person 43 announces "car 4", and the verbal remote control device borne by the person 44 announces "car 3". Of course, no announcement is made to the person 45, who begins to turn the corner into the additional corridor 31.

Figure 4:
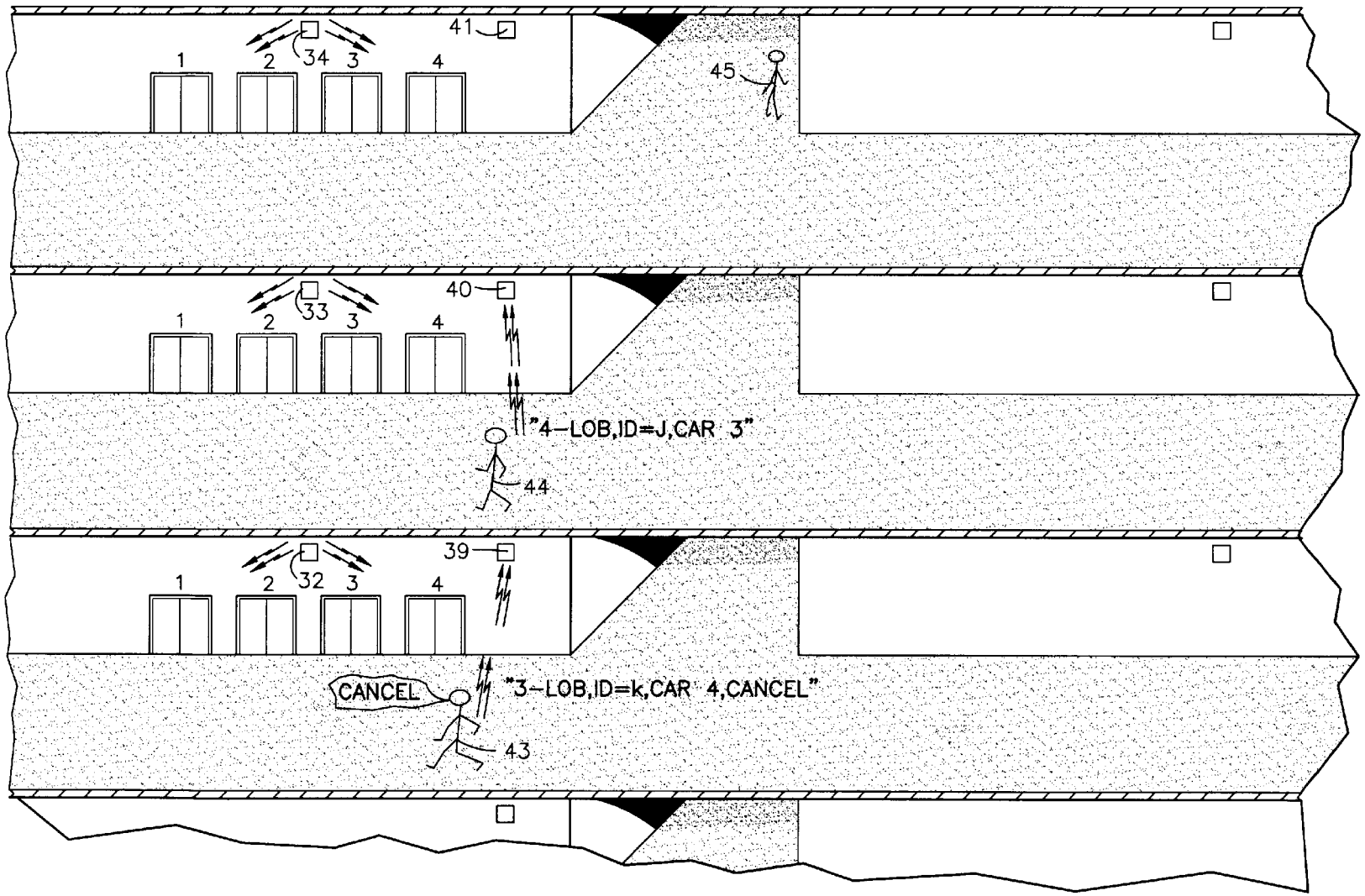

At this point in the sequence, the hall calls are all entered in cars for the pick up floors, the destination floors are noted, and the dispatcher knows the identification number of the persons (devices) who have requested those calls. As seen in FIG. 4, by the time an intended passenger reaches a corresponding one of the elevator landings 23–25, the verbal remote control device will be in range of a corresponding prompt beacon 32–34. This time, the personal devices which have requested a call (e.g., those on persons 43, 44) need not respond to the beacon by providing a human-perceptible prompt (as in FIG. 1); each device can remember that it has already transmitted a call request. On the other hand, each device within the range of a beacon may provide a human prompt, if desired. In any event, the prompt by the beacons 32–34 will cause any device in the area to respond to the prompt, with a new tag to identify the beacon 32–34 to which it is responding. In one embodiment, the response may include a second tag to identify the elevator car to which the related call was assigned. Thus, the device on person 44 (FIG. 4) responds to a prompt from beacon 33 with "4-Lobby, ID=j, CAR 4".

This transmission with the lobby tag acts as a confirmation of the call, in accordance with the present invention. Assuming that no other passengers are to be picked up on the fourth floor at this time, in the event that such call by passenger 44 is not confirmed by the indication of person 44 being present at the elevator lobby, by virtue of the lobby beacon tag in the response of his personal device, then, when elevator car 3 reaches the stop control point for the fourth floor without confirmation of the call, the hall stop will be cancelled so as to avoid a false stop. Of course, if other passengers have requested service from or to the fourth floor, then the car will stop for them if they are present at the lobby or in the car. When the call is cancelled, because the passenger is not present to be picked up by the first car which was assigned to the call, several options are available. In a preferred embodiment, if car 3 had no passengers and no other hall calls assigned to it, it could simply wait at floor 4 until it had further demand, which could in fact be the appearance of passenger 44. If car 3 had other present demand, the call, including the pickup floor and the destination floor, could simply be reassigned to some other car in the usual fashion. Before or after reaching the landing 23, if the person 43 said "cancel" as in FIG. 4, the verbal remote control device borne by him would transmit a message cancelling the hall call and destination call requested on floor 3, assigned to car 4, for the person whose device ID number is k. On the other hand, instead of cancelling the call, the person 43 could have said "19" or "office" to change the call. An important aspect of the aforementioned U.S. Pat. No. 5,952,626 is that voice reception by a unique device allows matching each new request with a specific previous request which must be concomitantly changed.

Transmission of the car assignment tag allows confirmation of which car the device announced to the user and can provide verification of call/car relationships in the dispatcher, as described more fully in aforementioned U.S. Pat. 5,984,051.

Figure 5:
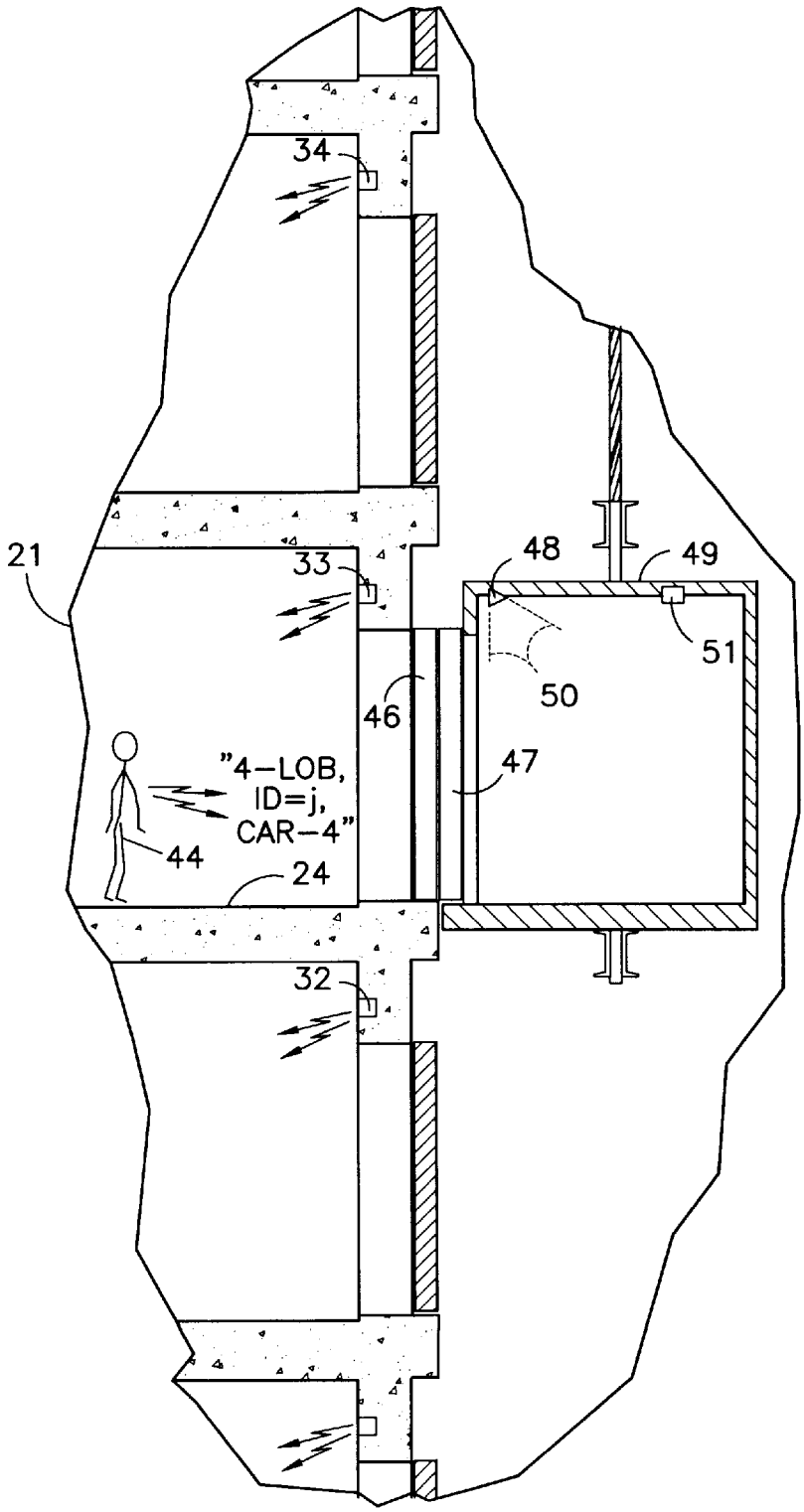
FIGS. 5 and 6 are partial, partially sectioned side elevation views of the elevator lobbies of FIGS. 1–4, illustrating additional sequences in accordance with the present invention.
Figure 6:
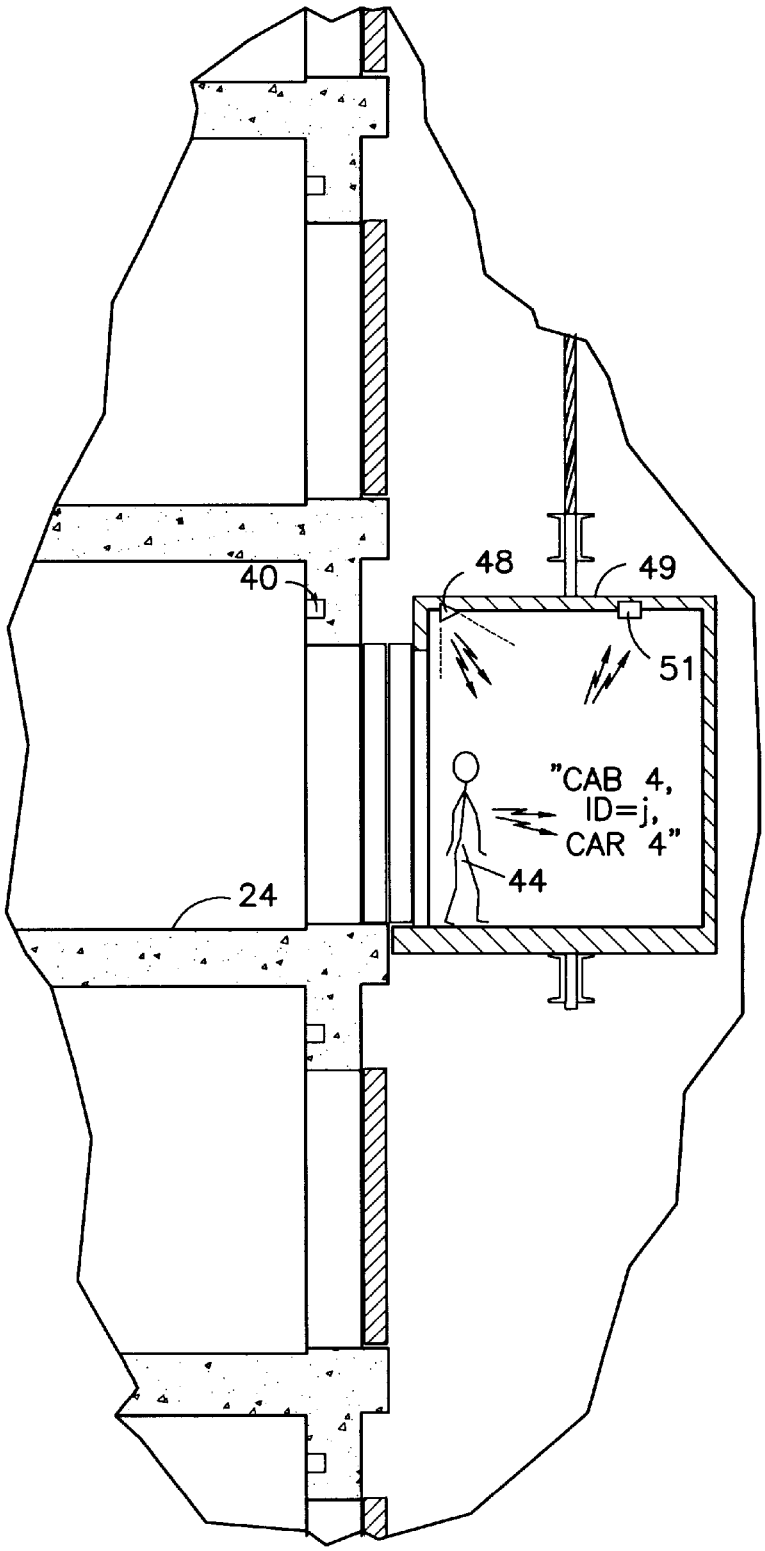

Referring now to FIG. 5, the person 44 is standing at the landing 24 waiting to enter elevator car 3, the fourth floor hoistway doors 46 and elevator doors 47 of which have just opened. The beacons 32–34 at the lobby should be of limited power and/or have directional sensitivity so as to not excite any personal devices within an adjacent elevator cab with the doors open. In FIG. 6, a beacon 48 within the cab 49 of elevator 3 is directional, as indicated by the dotted lines 53. This is to prevent the beacon 48 from prompting the remote control device on the person 44, prior to the person 44 entering the cab 52. Once the beacon 48 prompts the device on person 44, it responds indicating it is in cab 4, the ID is j, and it was assigned to car 4.

When a transceiver 51 receives transmissions from the device borne by the person 44, with the cab 4 locator tag, it is known that the person is within the cab 52. In accordance with the invention, the presence of the identified passenger within the cab 49 is utilized to confirm the destination portion of the request for service, and causes the dispatcher to enter a car call for elevator car 3, which for the person 44 in the example herein will be the default floor for that person. Thus, the invention utilizes the presence of the passenger at the lobby, that is, in the immediate vicinity of the elevator, to verify the hall call portion of the request for elevator service and cause the elevator car to stop at the origin floor, and utilizes presence of the passenger within the elevator cab to verify the destination portion of the hall call and enter a car call for the requested floor.

If the passenger does not enter the cab after a hall stop is made to pick up that passenger, the elevator system may employ different options. For instance, the call may simply be cancelled, or the call may be assigned to some other car, one or more times, depending on the nature of service which is desired.

The invention has been described in the foregoing example which includes utilization of a verbal remote device; however, it should be clear that the precepts of the invention may be practiced utilizing devices which are totally passive and can only enter a request for a default floor, devices which operate in response to keys, to permit passenger participation in the call request in the same fashion as has been described with respect to a verbal remote device, or other devices.

The invention has been described in an example which is currently deemed to be the best mode for practicing the invention. However, the invention may also be practiced utilizing other characteristics of beacons, remote devices, transmitters and receivers, as described hereinbefore. The present invention may be used with elevator systems having a traditional request that an elevator receive the passenger on a particular floor, following which the passenger will enter the destination floor as a car call by means of a button on the car operating panel; alternatively, the invention may be used in an elevator system employing destination calls, in which both the origin and destination floor are specified. The destination floor may be specified implicitly as simply relating to the ID of the device which the passenger is carrying, comprising the normal destination floor for that passenger, or the destination floor may be one that is entered explicitly by the passenger as the request is being made, or as a substitute floor for the normal default floor. All of this is irrelevant to that aspect of the invention which verifies presence of the passenger to fulfill a hall stop at the origin floor; when destination calls are used, the manner of establishing the ultimate destination portion of the call is irrelevant to the present invention. Thus, destination call messages utilized with the invention include a destination floor, whether it be defined by the device ID, defined by numbers entered verbally or by switches, or defined by functions (cafeteria, office) entered verbally or with switches.

The aforementioned patent applications are incorporated herein by reference.

Thus, although the invention has been shown and described with respect to exemplary embodiments thereof, it should be understood by those skilled in the art that the foregoing and various other changes, omissions and additions may be made therein and thereto, without departing from the spirit and scope of the invention.

We claim:

1. A method for remotely entering calls for service by selected ones of a plurality of elevators between floors of a structure, comprising:

(a) transmitting a call message indicative of a request for elevator service from a device carried by a person while said person is at a position on a given floor separated from the elevator by a distance equivalent to a walking time of between five and twenty seconds;

(b) assigning said request for service to a selected one of said elevators;

(c) entering a hall stop for said selected elevator to stop at said floor in response to said message;

(d) determining if said person carrying said device is or is not in the immediate vicinity of said elevators; and alternatively, (e) if said person is in the vicinity of said selected elevator when said selected elevator reaches a stop control point for said given floor, causing said selected elevator to stop at said floor; or (f) if said person is not in the vicinity of said selected elevator when said selected elevator reaches said stop control point, cancelling said hall stop unless a hall stop has been entered for said given floor for another passenger.

2. A method according to claim 1 wherein:

said call message includes a message portion identifying a destination floor; and said step (e) includes entering a call stop for said selected elevator to stop at said destination floor.

3. A method according to claim 1 wherein:

said step (f) includes assigning said request for service to a second one of said elevators and entering a hall stop for said second elevator to stop at said given floor.

4. A method for remotely entering calls for service by selected ones of a plurality of elevators between floors of a structure, comprising:

(a) transmitting a call message indicative of a request for elevator service from a device carried by a person, said request including service from an origin floor to a destination floor;

(b) assigning said request for service to a selected one of said elevators;

(c) entering a hall stop to cause said selected elevator to stop at said origin floor in response to said message and open its door for access thereto by passengers;

(d) determining if said person carrying said device is within the cab of said elevator; and alternatively (e) if said person is within said cab, entering a call stop for said elevator to stop at said destination floor; or (f) if said person is not within said cab, not entering said call stop for said destination floor.

5. A method according to claim 4 wherein said step (f) further comprises:

assigning said request for service to another one of said elevators.

6. A method for remotely entering calls for service by selected ones of a plurality of elevators between floors of a structure, comprising:

(a) transmitting a call message indicative of a request for elevator service from a device carried by a person while said person is at a position on a given floor separated from the elevator by a distance equivalent to a walking time of between five and twenty seconds, said request including service from an origin floor to a destination floor;

(b) assigning said request for service to a selected one of said elevators;

(c) entering a hall stop to cause said selected elevator to stop at said origin floor in response to said message and open its door for access thereto by passengers;

(d) determining if said person carrying said device is or is not in the immediate vicinity of said elevators; and alternatively, (e) if said person is in the vicinity of said selected elevator when said selected elevator reaches a stop control point for said given floor, causing said selected elevator to stop at said floor; or (f) if said person is not in the vicinity of said selected elevator when said selected elevator reaches said stop control point, cancelling said hall stop unless a hall stop has been entered for said given floor for another passenger;

(g) determining if said person carrying said device is within the cab of said elevator; and alternatively (h) if said person is within said cab, entering a call stop for said elevator to stop at said destination floor; or (i) if said person is not within said cab, not entering said call stop for said destination floor.

* * * * *